United States Patent [19]

Jackman

[11] Patent Number: 4,561,459

[45] Date of Patent: Dec. 31, 1985

[54] REMOTE FIRE HYDRANT ACTUATOR

[76] Inventor: William Jackman, E. 2526 Cleveland, Spokane, Wash. 99207

[21] Appl. No.: 651,174

[22] Filed: Sep. 17, 1984

[51] Int. Cl.[4] ..... E03B 9/04; F16K 31/02

[52] U.S. Cl. ..... 137/291; 169/24; 239/587; 251/148; 251/151; 251/129.04

[58] Field of Search ..... 137/272, 291, 292; 169/19, 24, 30, 54, 61, 62; 239/587; 251/131, 148, 151; 285/272, 399, 402

[56] References Cited

U.S. PATENT DOCUMENTS

| | | | |
|---|---|---|---|
| 123,355 | 2/1872 | Mumler | 340/320 |
| 578,716 | 3/1897 | Buchtel | 340/320 |
| 710,246 | 12/1901 | Buchtel | 340/320 |
| 821,639 | 12/1904 | Hart | 340/320 |
| 3,363,640 | 1/1968 | Gallo, Sr. | 251/151 |
| 3,451,628 | 6/1969 | Kelley | 239/587 |
| 3,583,637 | 6/1971 | Miscovich | 239/587 |
| 3,599,722 | 8/1971 | Davidson et al. | 169/24 |
| 3,762,478 | 10/1973 | Cummins | 169/24 |
| 3,770,062 | 11/1973 | Riggs | 169/24 |
| 3,786,869 | 1/1974 | McLoughlin | 169/24 |
| 3,989,109 | 11/1976 | Gagliardo | 169/24 |
| 4,090,532 | 5/1978 | Story, Jr. | 251/131 |
| 4,189,005 | 2/1980 | McLoughlin | 169/24 |
| 4,306,314 | 12/1981 | Griffiths | 251/131 |

OTHER PUBLICATIONS

Brochure: Snap-Tite Remote Hydrant Operator by Snap-Tite, Inc., Union City, PA 16438.

*Primary Examiner*—George L. Walton

*Attorney, Agent, or Firm*—Wells, St. John & Roberts

[57] ABSTRACT

An apparatus for attaching a fire hose to a fire hydrant and for facilitating remote operation of the hydrant actuator stem. A water supply module containing a length of conduit is coupled between a hydrant port and a fire hose. An articulated boom supports an upper motor assembly coupled to the actuator stem of the hydrant. A remote transmitter can be used to broadcast control signals to the water supply module to operate the motor assembly. The motor assembly rotates the actuator stem of the hydrant between fully closed and fully open positions. The apparatus frees a fire fighter normally stationed at the hydrant, permitting the fire fighter to engage in the initial fire fighting activities at the scene of a fire.

13 Claims, 10 Drawing Figures

REMOTE FIRE HYDRANT ACTUATOR

FIELD OF THE INVENTION

This invention relates to a remotely-controlled apparatus for operating a conventional fire hydrant.

BACKGROUND OF THE INVENTION

The extinguishment of a building fire by use of water assumes the presence of an adequate water supply. It can be initially provided by a pumper vehicle with a tank of limited water storage capacity. Where a greater volume of water is required, it is usually provided through fire hydrants and fire hoses. The basic purpose of this invention is to provide remotely-controlled operation of a hydrant, thereby freeing the individual normally required for hydrant operation for initial fire fighting duties and possibly for lifesaving procedures that might be required initially at the scene of a fire.

This invention arose as a solution to a long standing dilemma in fire fighting—to utilize a hydrant water supply when approaching the scene of a fire, which typically results in lost time and personnel; or to bypass the hydrant and rely on the water available in the pumping vehicle, which maintains crew integrity at the risk of limiting subsequent tactical options due to an insufficient supply of water. The present apparatus assures an adequate supply of water at the scene of a fire without the associated initial loss of personnel.

Except in those instances where a fire is clearly of minor proportions, the utilization of the virtually unlimited water supply afforded by fire hydrants is considered desirable for several reasons. First, the volume of water actually required to completely extinguish the fire will very often exceed that available in the mobile vehicle tank. Secondly, the supply of water from a fire hydrant can be used to "boost" pumper performance. The unlimited water supply can be used at higher pressures and volumes than would be prudent if one were relying upon a limited tank volume. Thirdly, the larger water supply available from a fire hydrant provides the fire fighting crew with greater tactical options in attacking the fire. Finally, should mechanical malfunction of the pump apparatus occur, the water pressure available from the fire hydrant itself is often sufficient to assure that the fire is extinguished.

When using conventional mobile equipment to approach the scene of a fire, it is typical today to initially stop at a hydrant near the scene, leaving a fire fighter to attach the fire hose and to subsequently open the hydrant valve. The apparatus then proceeds to the scene without that individual. This leaves the initial fire fighting crew one individual short, which can be critical in the first moments of fighting a fire. With the present device, the same crew member must only mount the device and attached hose to a hydrant. The fire fighter is then free to immediately return to the temporarily stopped vehicle and can continue to the scene of the fire to assist in activities as required in those critical initial moments. The hydrant can be subsequently operated by remote control.

The present apparatus was developed to provide remotely operated equipment that could be mounted to a hydrant as quickly as a conventional fire hose. A large number of different manufacturers have typically provided fire hydrants of various designs to municipalities and fire districts over the life of its fire fighting system. They vary in size, shape and design. The present apparatus is capable of adapting to many of the design idiosyncrasies that might be encountered. It can be fitted on any hydrant with a side port and top valve actuator stem.

As background, a series of very old patents illustrate the use of conductors along a fire hose for signalling desired operations to a remote position at which a second person can manually open and close selected valves. These are U.S. Pat. Nos. 123,355; 578,716; 821,639; and 710,246.

U.S. Pat. No. 4,090,532 discloses a battery operated control valve that can be remotely controlled by an operator at a different location. U.S. Pat. No. 4,306,314 discloses a fiber optic system for transmitting control signals from a remote location to a motor-driven valve.

Remotely operated fire fighting equipment is disclosed in U.S. Pat. Nos. 3,599,722 and 3,770,062, both of which disclose snorkel equipment. A complete remote controlled vehicle is shown in U.S. Pat. No. 3,762,478.

U.S. Pat. No. 4,189,005 is of specific interest because it discloses a system where water flow is computer controlled. In FIG. 11 there is a general diagram of a transmitter that sends a signal to a receiver at a hydrant valve control 101. The valve 101 provides remote control of hydrant operation. The system also includes a sensor 74 for detecting low hydrant pressure. The pump operator has remote control of the hydrant valve 101.

A remotely controlled hydrant valve is also known to be commercially available. It is identified as the "SNAP-TITE" remote hydrant operator, produced by the Fire Products Division of Snap-Tite, Inc., Union City, Pa. It uses a radio receiver to operate a valve attached to an open fire hydrant.

None of the prior equipment discussed above provides an apparatus for remotely opening and closing a conventional hydrant valve. The remotely operated hydrant valves are additional valves coupled to an open hydrant port, and require the time consuming step of manually operating the hydrant valve before leaving the hydrant.

BRIEF DESCRIPTION OF THE DRAWINGS

The invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
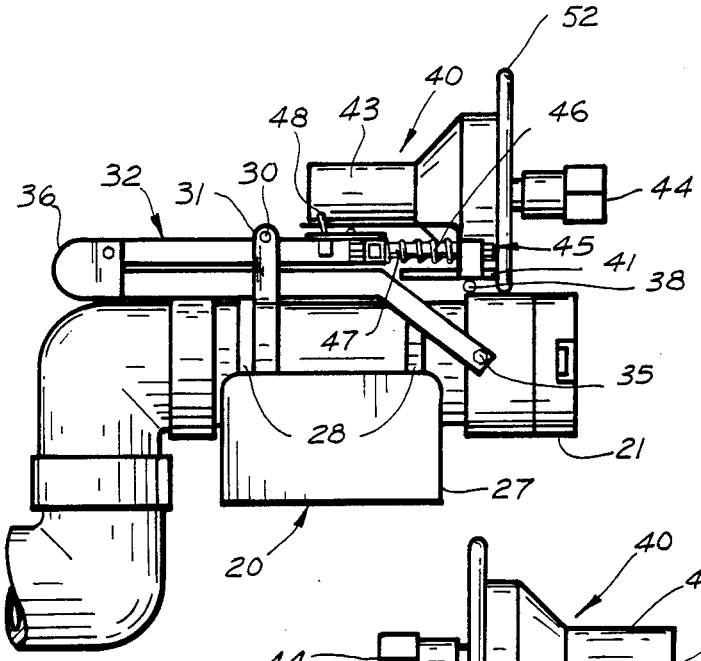
FIG. 1 is a side view of the apparatus in a folded condition.
Figure 2:
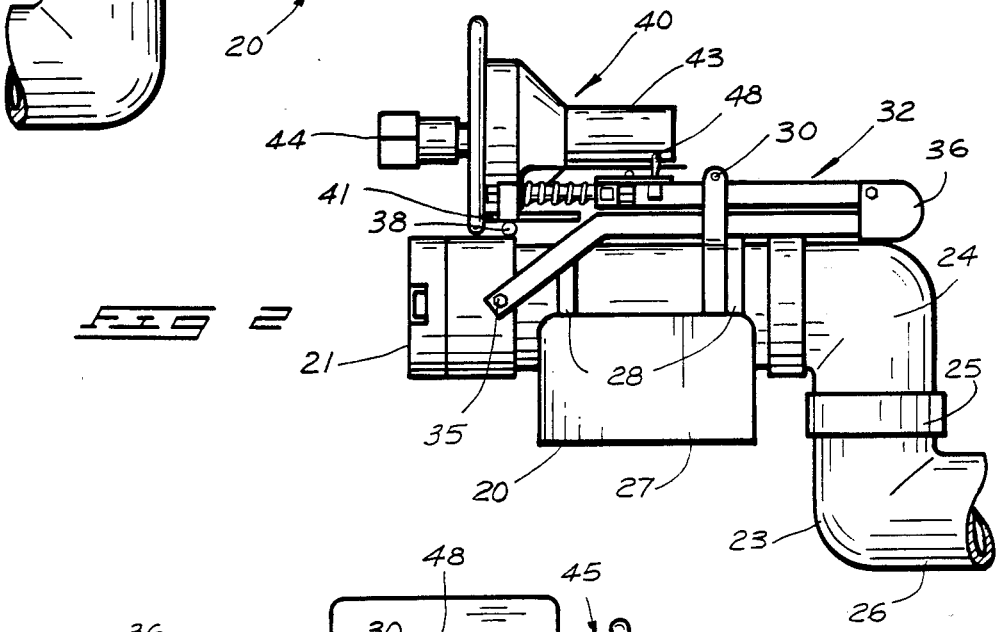
FIG. 2 is an opposite side view.
Figure 3:
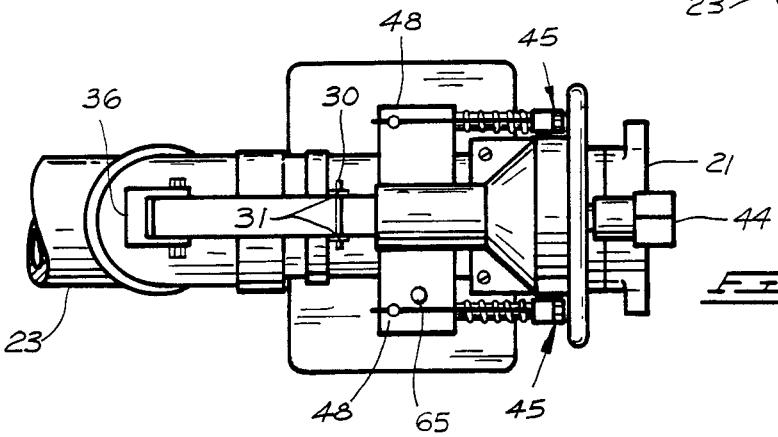
FIG. 3 is a top view.
Figure 4:
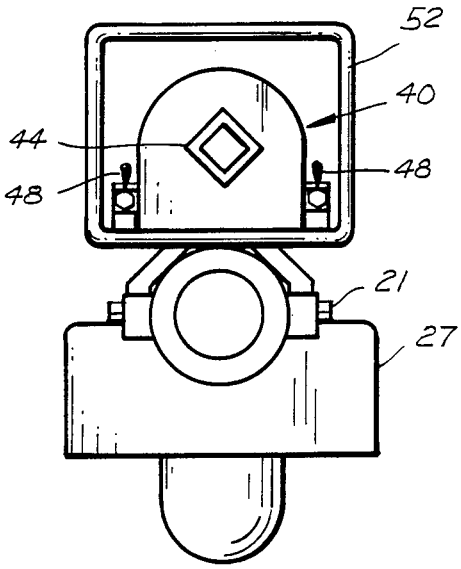
FIG. 4 is a right end view.
Figure 5:
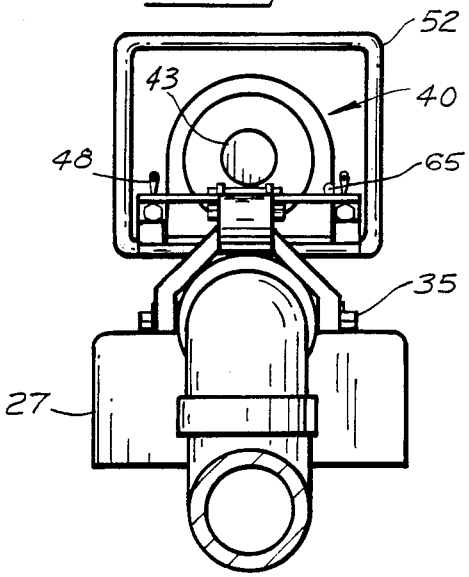
FIG. 5 is a left end view.
Figure 6:
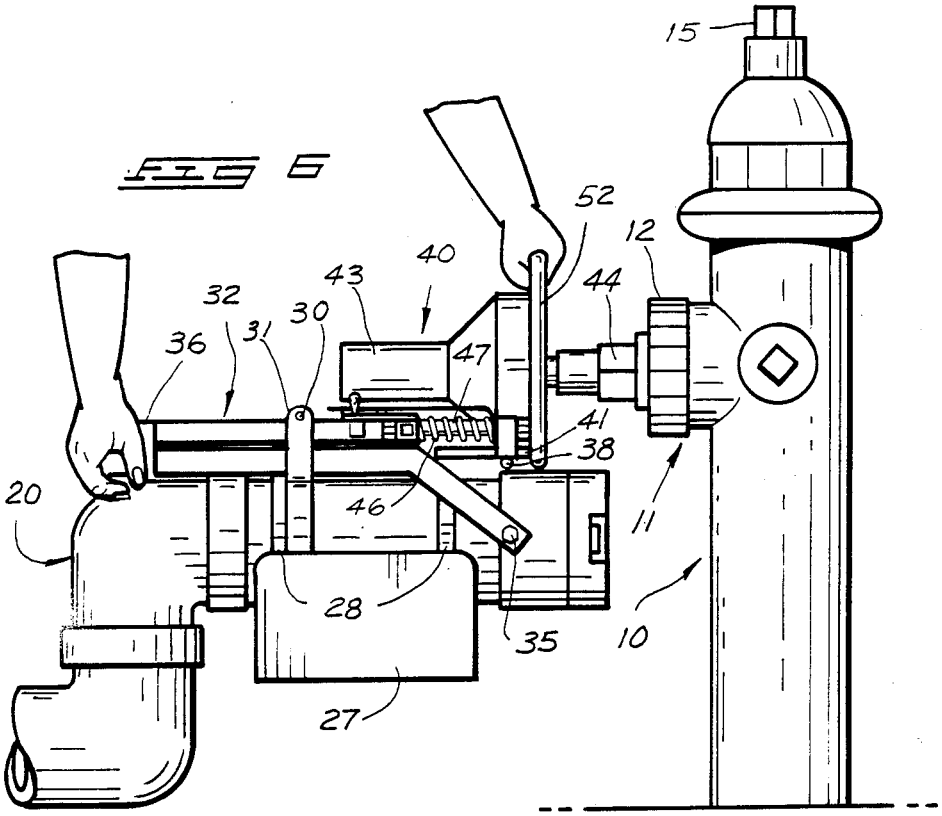
FIG. 6 is an elevation view showing use of the apparatus to remove a port cover.

The fire hydrant operating apparatus shown in the enclosed drawings comprises a portable unit adapted to facilitate the attachment of a fire hose to a conventional fire hydrant, and further provides for remote actuation of the fire hydrant valve to control flow of water as required at the scene of a fire. Its components are movable between a storage condition, shown in FIGS. 1 through 7, and an operative condition, shown in FIGS. 8 and 9. It is adapted to be carried on a fire truck in the storage condition, where the motorized drive socket of the equipment is positioned to assist in the removal of a side port cover 12 on a conventional fire hydrant (FIG. 6). FIG. 6. The apparatus is next fixed to the fire hydrant 10 by direct attachment to its side port 11. When the movable boom 32 is then extended outward from the supporting water supply module 20, the drive socket 44 can be utilized to rotate the valve actuator stem 15 at the top end of the fire hydrant 10.

The present equipment is designed for use in conjunction with any conventional fire hydrant 10 having a side port 11 and a top mounted mechanical valve actuator stem 15. As will be evident below, the present apparatus is extremely versatile in accommodating the different sizes and configurations of fire hydrants that might be encountered, even within a single fire fighting area or district.

The fire hydrant actuator includes a rigid water supply module 20, which serves as the basic portable support frame for the movable components of the apparatus. A hydrant coupler 21 is movably mounted at one axial end of the water supply module. It selectively fixes the water supply module to the side port of a fire hydrant. A hose coupler 23 at the opposite axial end of the water supply module 20 selectively attaches to the end of a fire hose 14. The water supply module 20 also includes a length of conduit 22 that extends between the hydrant coupler 21 and the hose coupler 23. The conduit 22 is in open communication between the couplers 21 and 23 for directing water from the fire hydrant 10 to the hose 14.

An articulated boom 32 is movably supported on the water supply module 20. It supports a motor assembly 40 that selectively rotates an open drive socket 44. A power supply and control cabinet 27 is suspended from the water supply module 20. The control circuitry for motor assembly 40 can be remotely or manually activated to selectively cause the motor-driven socket 44 to be rotated.

Referring more specifically to the details of the drawings that accompany this description, the portable water supply module 20 comprises a rigid length of conduit 22, which presents an enclosed water chamber leading between the hydrant coupler 21 and hose coupler 23. Both couplers 21 and 23 can have a number of different structures, so long as they attach to a conventional hydrant port 11 and fire hose 14. As shown, the hydrant coupler 21 can constitute a quick coupler adapted to attach to a complementary hydrant port. Alternatively, the hydrant coupler 21 can be a rotatable threaded coupler.

The hose coupler 23 is shown attached to an upper elbow 24, a vertical swivel connector 25, and a lower elbow 26. The swivel connector 25 provides freedom of hose movement about its vertical axis, to minimize the possibility of kinking of an attached fire hose 14. It is to be understood that any suitable rigid or swivel coupling can be utilized to connect the outer end of fire hose 14 to module 20.

The suspended power supply and control cabinet 27 is fixed to the conduit 22 by encircling straps 28. The cabinet 27 houses the motor control circuitry, which might include various relays and solenoids, as well as a radio receiver for remote operational control of the apparatus, and required batteries.

When the apparatus is in its folded condition as shown in FIGS. 1 through 7, the boom 32 is held adjacent to conduit 22 by a releasable transverse locking pin 30 extending between a pair of upright locking supports 31 on the module 20.

The articulated boom 32 includes a lower arm 33 and an upper arm 34. They are essentially similar in length and are joined by a pivot elbow 36. The lower arm 33 includes a rigid extension bracket 39 at the pivot elbow 36, which provides a handle for partially suspending the apparatus, as shown in FIG. 6.

The inner end of arm 33 is pivotally connected to the water supply module 20 about a transverse pivot pin 35. The outer end of arm 34 is also pivotally connected to the motor assembly 40 by a pivot pin shown at 38. The axes of the pins 35 and 38, as well as the axis of the pivot elbow 36, are parallel to one another. Each axis is also transverse to the central longitudinal axis through conduit 22.

Motor assembly 40 comprises a DC motor 43 mounted to a supporting motor pad 41 that is pivotally mounted relative to upper arm 34 of boom 32 about the previously-described pivot pin 38. The motor 43 includes a drive shaft provided with an open outer socket 44 having a recess that is complementary to the multi-sided lug centered on a fire hydrant port cover 12, as well as the usual upstanding valve actuator stem 15. For more versatility, the socket 44 can have tapered or multi-sided inner surfaces capable of engaging a range of lug and stem sizes.

The outer end of upper arm 34 on boom 32 is provided with a pair of rigid side rods 45 which extend outwardly from it. The rods 45 slidably guide a pair of slide bushings 47 which transversely support the upper pivot pin 38 that pivotally supports motor assembly 40. The slide bushings 47 are yieldably urged outward by surrounding compression springs 46. Bushings 47 provide a rotatably yielding support for motor assembly 40, and act in concert with limit switches 48 to provide torque responsive control for motor operation. Two limit switches 48 are positioned at the outer end of arm 34 in alignment with the respective slide rods 45. Each switch 48 is actuated by a longitudinal rod 51 extending between the switch actuator and the respective slide bushings 47. When the slide bushing 47 at either side of motor assembly 40 is urged inwardly due to torque applied to it by motor assembly 40, it will trip the associated limit switch 48 to terminate motor operation. This will occur only when motor assembly 40 stalls under load. This mechanical arrangement has been provided to assure that the valve actuator stem 15 is moved to a fully open or fully closed position each time that the motor assembly is remotely actuated.

The mechanical functions of the apparatus can best be understood by viewing FIGS. 6 through 9. The apparatus will be typically stored at the rear of a fire fighting vehicle. A fire fighter can manually carry the apparatus from the vehicle to the hydrant site, dragging along the outer end of an attached fire hose 14. The apparatus can be grasped by the handle bracket 39 at the elbow 36 of boom 32, and by a tubular handle 52 fixed to the motor pad 41. This provides a balanced arrangement for easily holding the apparatus in a horizontal position.

With the apparatus suspended by a person holding it, as shown in FIG. 6, and with the motor assembly 40 pivoted on the folded boom 32 to a position with the socket 44 axis being parallel to the conduit axis, the open socket 44 can readily engage a lug at the center of a side port cover 12 on a fire hydrant. The motor assembly 40 can then be manually operated to rotate cover 12, removing it from the fire hydrant 10.

Figure 7:
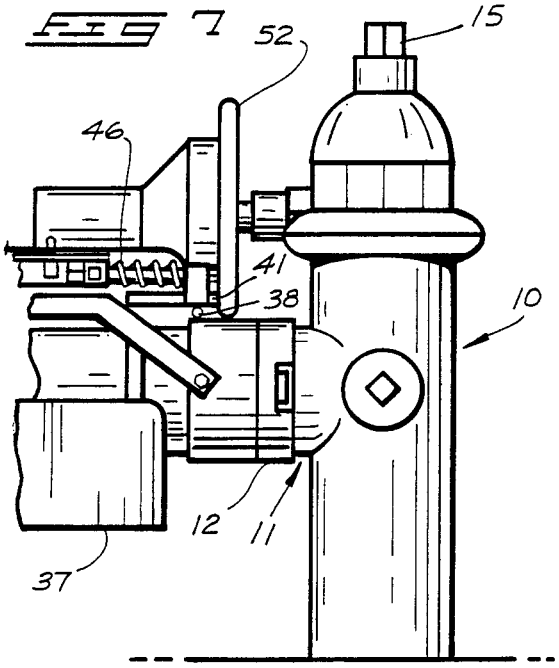
FIG. 7 is a partial elevation view showing the apparatus attached to a side port.

After the cover has been removed from the side port 11, the present apparatus must be lifted slightly to align the hydrant coupler 21 with the complementary side port 11 on fire hydrant 10. This position is shown in FIG. 7. The hydrant coupler 21 can then be manually pivoted or turned about the axis of water supply module 20 to properly fix the module 20 to the hydrant side port 11. While the illustrated equipment shows a manually actuated hydrant coupler 21, it is to be understood that the coupler 21 could also be powered. This could be accomplished by an independent motor for driving the coupler 21, or by a releasable power transmission drivingly coupling motor 43 to the coupler 21.

Figure 8:
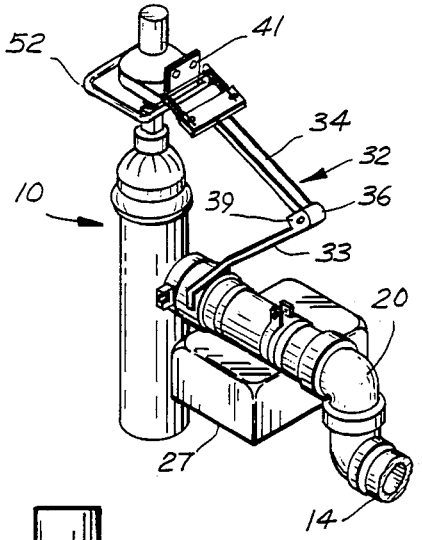
FIG. 8 is a reduced perspective view of the apparatus attached to a hydrant.
Figure 9:
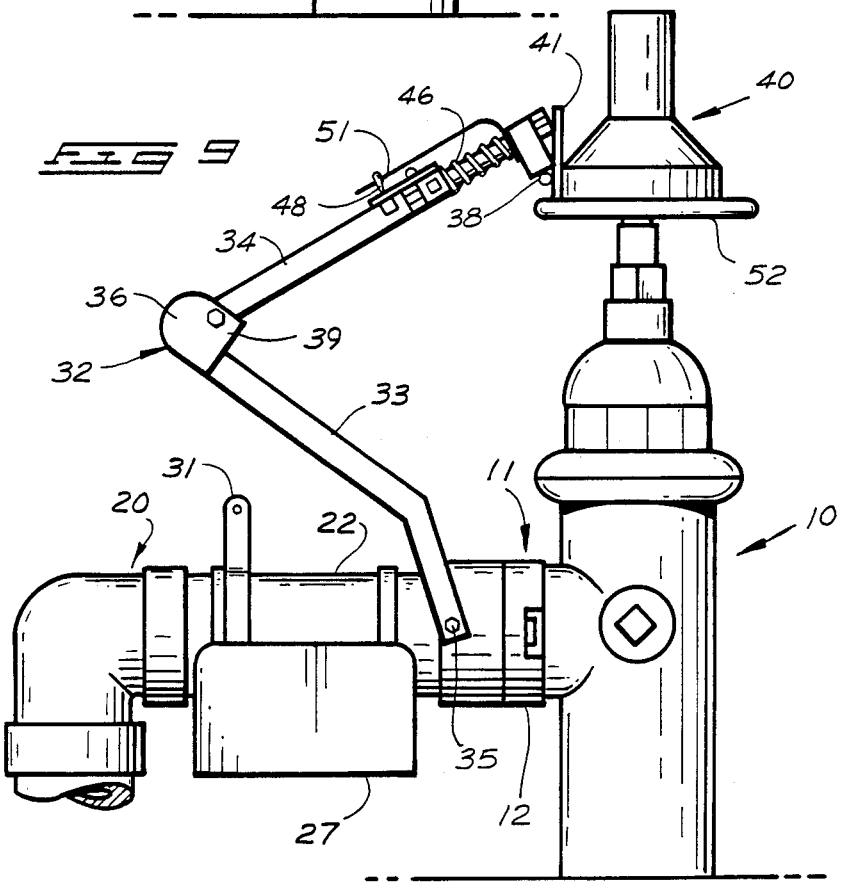
FIG. 9 is a side elevation view of the apparatus in an operative condition.

After the water supply module 20 is fixed to hydrant 10 in a cantilevered outward position, it serves as a rigid frame or support for the movable motor assembly 40. The motor assembly 40 can be raised into an operative condition after first releasing locking pin 30. The articulated boom 32 and the pivoted mount between motor assembly 40 and the upper end of boom arm 34 allow the motor assembly 40 to be positioned over the hydrant 10 as shown in FIGS. 8 and 9. The open socket 44 can then be manually engaged about the upper end of valve actuator stem 15. Socket 44 serves to vertically support the motor assembly 40 on stem 15. The motor assembly 40 is braced against rotation by the interconnecting pivotal joints along the boom 32. The motor 43 is capable of being operated in reverse directions to open or close the hydrant valve.

The present apparatus is designed specifically for remote operation of a fire hydrant. As can be seen by the above description, it requires no modification of the existing hydrant structure. It does provide effective modification of the procedures by which the water supply available through the hydrant can be used at the scene of a fire.

Figure 10:
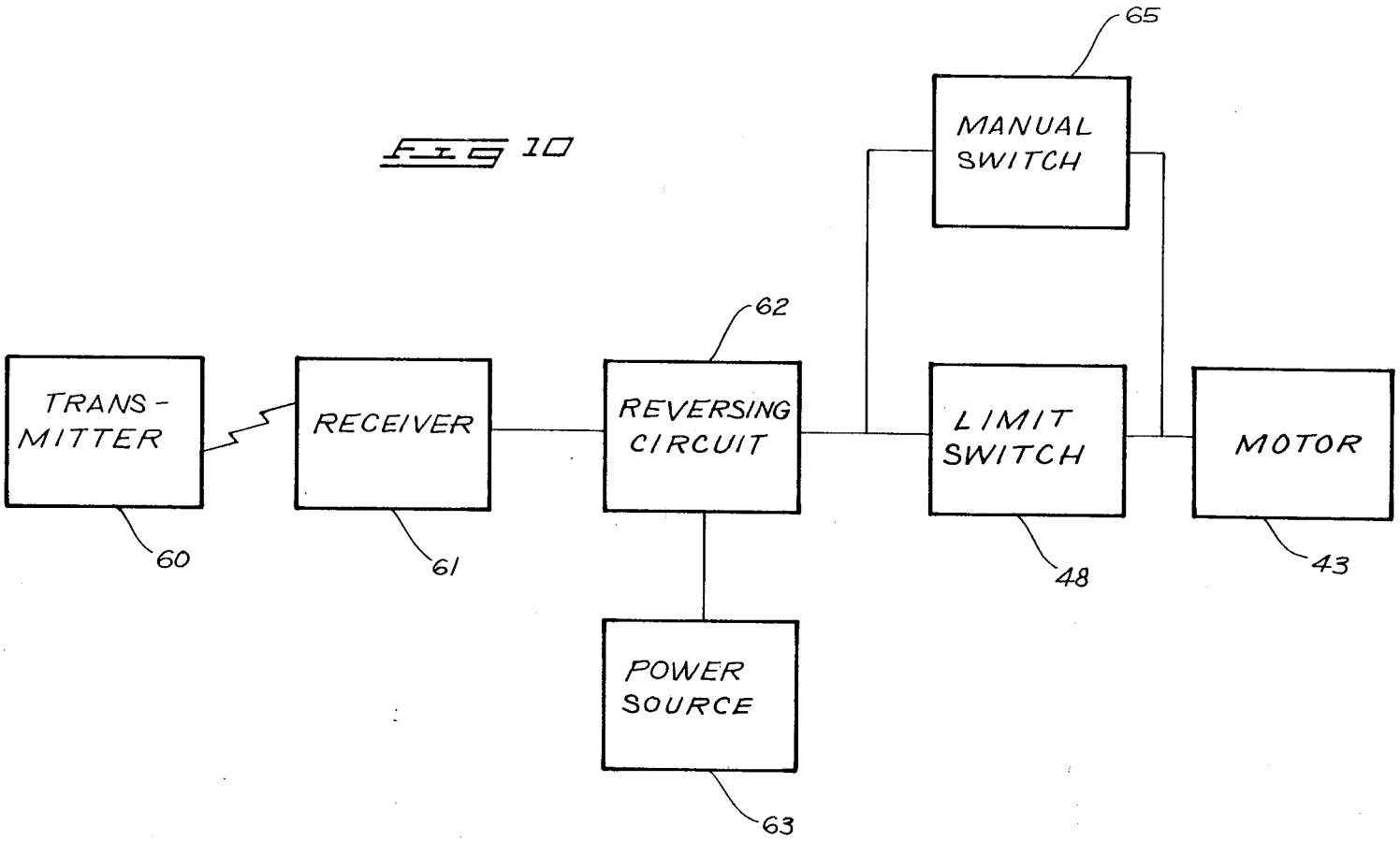
FIG. 10 is a block diagram of the control system for the apparatus.

Because the electrical or electronic components required to effectively operate motor 43 are subject to a wide variety of design modifications, a block diagram of the control components is believed to be adequate to describe the control circuitry to those familiar with such equipment. FIG. 10 shows a radio transmitter, which can be a special unit or the available radio transmitter in an associated fire fighting vehicle.

A radio receiver 61 mounted within cabinet 27 on the water supply module 20 is adapted to receive coded signals broadcast from the remote transmitter 60. Upon receiving such signals, the receiver 61 will step the control circuitry through a predetermined sequence of operation. This will first involve rotating the socket 44 on motor 43 in a direction required to open the fire hydrant valve. Secondly, it will involve rotating the motor 43 in a reverse direction to close the fire hydrant valve. The direction of operation will be controlled by a sequential reversing circuit 62 which will provide power to motor 43 to rotate its shaft in opposite directions each time a signal is provided from receiver 61. It can be either automatically or manually reset to assure a proper sequence of operation each time it is installed on a hydrant. Reversing circuit 62 is interposed between a portable power source 63, such as storage batteries, and a complementary DC electric motor 43. The previously-described limit switches 48 are wired in series between reversing circuit 62 and motor 43 so as to be capable of opening the power circuit to motor 43 when the torque on the motor causes either switch 43 to be activated. A manual switch 65 is wired in series with the limit switches 48 to permit fire fighting personnel to override the remote operation of the equipment when desired, and also to provide manual control of motor 43 for removal of a side port cover 12.

The operation of the apparatus is believed to be evident from the above description. Its essential purpose is to free the fire fighter who would normally be utilized to manually operate the fire hydrant, so that the fire fighter can perform more urgent duties at the initial scene of a fire.

In compliance with the statute, the invention has been described in language more or less specific as to structural features. It is to be understood however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An apparatus for controlling operation of a fire hydrant having a side port and a top mounted mechanical valve actuator stem, comprising:

a rigid water supply module;

hydrant coupler means movably mounted on said water supply module selectively fixing it to a side port of a fire hydrant;

hose coupler means on said water supply module for attachment to a fire hose;

conduit means on said water supply module in open communication between said hydrant coupler means and said hose coupler means for directing water from a fire hydrant to an attached fire hose;

a boom movably mounted to said water supply module;

motor assembly means movably mounted on said boom for drivingly engaging the valve actuator stem on a fire hydrant to which the water supply module is fixed; and control means operably connected to said motor assembly means for selectively causing it to rotate the valve actuator stem to control flow of water from the fire hydrant to an attached fire hose.

2. The apparatus of claim 1, wherein the hydrant coupler means, hose coupler means, and conduit means are coaxially aligned and centered about a common conduit axis.

3. The apparatus of claim 1, wherein the hydrant coupler means, hose coupler means, and conduit means are coaxially aligned and centered about a common conduit axis;

said boom being pivotally connected to said water supply module about an axis transverse to said conduit axis.

4. The apparatus of claim 1, wherein the hydrant coupler means, hose coupler means, and conduit means are coaxially aligned and centered about a common conduit axis;

said boom comprising a plurality of rigid members mounted to one another about pivot axes that are transverse to said conduit axis.

5. The apparatus of claim 1 wherein the control means comprises:

means responsive to operation of said motorized socket means for successively detecting that the valve actuator stem of a fire hydrant has been rotated to a fully open or fully closed condition.

6. The apparatus of claim 1 wherein the control means comprises:

torque responsive switching means operably connected to said motorized socket means for detecting a stall condition of said motor assembly means after initially rotating the valve actuator stem on a fire hydrant.

7. The apparatus of claim 1, wherein the control means comprises:

a manually operable portable controller remote from said water supply module.

8. The apparatus of claim 1, wherein the control means comprises:

a manually operable portable ratio transmitter remote from said water supply module;

and a radio receiver on said water supply module adapted to receive control signals that are broadcasted by said transmitter.

9. An apparatus for controlling operation of a fire hydrant having a side port and a top mounted mechanical valve actuator stem, comprising;

a portable water supply module adapted to be hand supported at the side of a fire hydrant with which it is to be used;

a length of water conduit on said water supply module;

a hydrant coupler at one end of the length of conduit, said hydrant coupler being adapted to fix the water supply module to a fire hydrant by attachment of the hydrant coupler to an open side port;

hose coupler means at the remaining end of the length of conduit for attachment to a fire hose;

an articulated boom movably mounted to the water supply module about a first transverse axis;

a motor assembly pivotably mounted to said articulated boom about a second transverse axis parallel to said first axis, said motor assembly having a reversible rotatable drive shaft;

a socket on the motor assembly drive shaft adapted to engage the valve actuator stem of a fire hydrant;

and control means operably connected to a motor assembly for selectively rotating its drive shaft to successively move an engaged valve actuator stem between fully closed and fully open conditions.

10. The apparatus of claim 9 wherein the boom is foldable relative to said first axis on said water supply module between a storage condition adjacent to it and an operative condition protruding outwardly from it.

11. The apparatus of claim 9 wherein the control means comprises:

limit switches adapted to open upon stalling of the motor assembly.

12. The apparatus of claim 9 wherein the control means includes a radio receiver adapted to initiate operation of the motor assembly in a stepped progression in response to receipt of predetermined broadcast signals;

and a radio transmitter at a location remote from the water supply module, said transmitter being adapted to broadcast the predetermined signals under manual command.

13. The apparatus of claim 9 wherein the articulated boom comprises:

a first rigid arm having an inner end pivotally mounted to the water supply module about said first axis at a location adjacent to said hydrant coupler;

a second rigid arm having an outer end pivotally mounted to said motor assembly about said second axis;

the first rigid arm having an outer end and the second rigid arm having an inner end pivoted to one another about a third axis parallel to said first axis, whereby the boom arms and motor assembly are foldable about said axes between a storage condition adjacent to the water supply module, and an operation condition protruding outwardly from it.

* * * * *